United States Patent [19]

Iiyama et al.

[11] 4,200,596

[45] Apr. 29, 1980

[54] THROTTLE VALVE APPARATUS IN AN INTERNAL COMBUSTION ENGINE AND ITS METHOD OF OPERATION

[75] Inventors: Masahiko Iiyama, Tokyo; Kazunori Itaya, Fujimi, both of Japan

[73] Assignee: Honda Giken Kogyo Kabushiki Kaisha (Honda Motor Co., Ltd.), Tokyo, Japan

[21] Appl. No.: 39,332

[22] Filed: May 15, 1979

[30] Foreign Application Priority Data

May 18, 1978 [JP] Japan ..... 53-58292

[51] Int. Cl.[2] ..... F02M 3/08

[52] U.S. Cl. ..... 261/65; 123/97 R; 137/67; 251/285; 251/288

[58] Field of Search ..... 137/67; 261/65; 123/198 R, 97 R; 251/285, 288

[56] References Cited

U.S. PATENT DOCUMENTS 2,393,760 1/1946 Eberhardt ..... 261/65

2,412,021 12/1946 Weakley ..... 251/285

*Primary Examiner*—Tim R. Miles

*Attorney, Agent, or Firm*—Haseltine, Lake & Waters

[57] ABSTRACT

A method and apparatus for compensating for increased engine idle speed upon breaking-in of an engine, comprising halting a throttle valve controlling admission of air-fuel mixture to the engine in an idling position of the engine by a stopper member and gradually and automatically shifting the halted idling position of the throttle valve in its closing direction to diminish the flow of air-fuel mixture to the engine to compensate for increased engine idle speed upon breaking-in of the engine. The gradual and automatic shifting of the idling position of the throttle valve is obtained by constructing either the throttle valve, or the stopper member or both with contact portions which are relatively easily worn or deformed so that as the portions undergo gradual wear or deformation, the throttle valve gradually moves in its closing direction to compensate for increase engine idle speed.

9 Claims, 3 Drawing Figures

THROTTLE VALVE APPARATUS IN AN INTERNAL COMBUSTION ENGINE AND ITS METHOD OF OPERATION

FIELD OF THE INVENTION

This invention relates to a throttle valve apparatus in an internal combustion engine for a motorcar or the like.

PRIOR ART

This type of engine has the general tendency that, in the initial stage of use after assembly of the engine, there is an initial wear (initial breaking-in) of respective constructional parts of the engine and consequently the idling speed of the engine is gradually increased. This is required to be compensated.

As a compensating measure, it has been hitherto conventional, for instance, to provide a stopper member for stopping the throttle valve in its idling position which is constituted as an adjusting screw. It has been usual with this arrangement for the adjusting operation to be carried out manually, and this is troublesome.

SUMMARY OF THE INVENTION

An object of the invention is to provide an apparatus in which the compensation of the idling position is carried out automatically.

In accordance with the invention, a throttle valve is arranged to be stopped, in the course of its operation in its closing direction, in an idling position by a stopper means, and the invention is characterized in that at least either the stopper means or a receiving member on the throttle valve facing the stopper means is provided with a portion which is easily deformed or worn, so that in an initial period after the beginning of use of the engine, said portion is gradually deformed or worn and thereby the idling position is gradually compensated towards its closing side.

BRIEF DESCRIPTION OF THE VIEWS OF THE DRAWING

Embodying examples of this invention will now be described with reference to the accompanying drawing.

DETAILED DESCRIPTION

Figure 1:
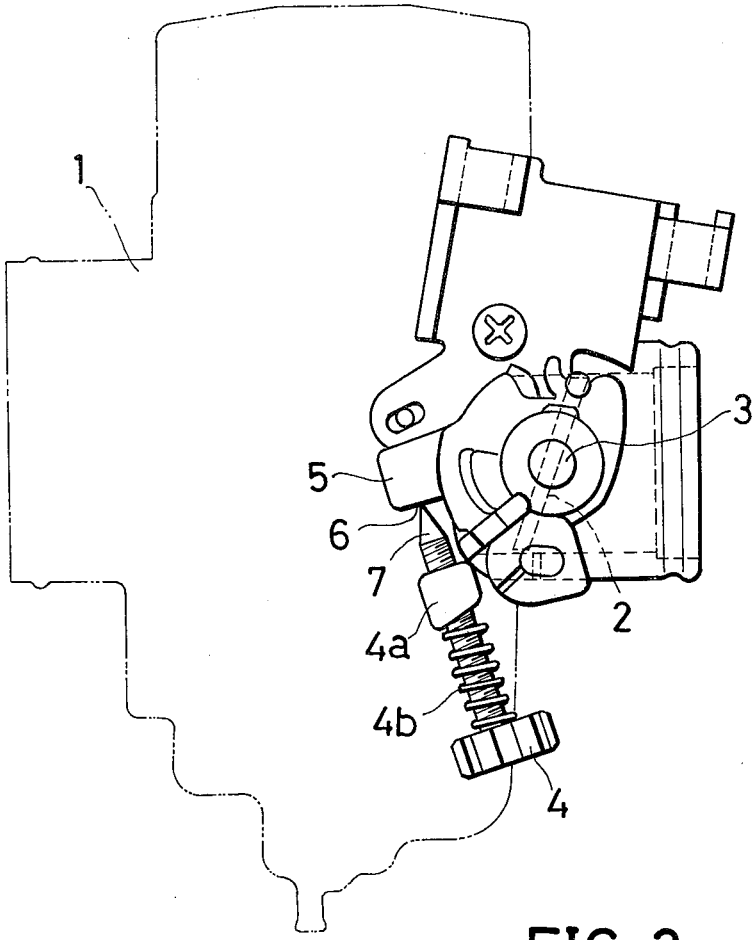
FIG. 1 is a side view of one embodiment according to the invention.

Referring to the drawing, numeral 1 denotes a carburetor main body connected to an intake manifold of an internal combustion engine, and numeral 2 denotes a throttle valve with carburetor. The valve 2 is turnable about a shaft 3 as illustrated or it can be movable upwards and downwards (not illustrated) to control supply of air-fuel mixture to the engine. A stopper member 4 is positioned to stop the valve 2 in an idling position for the engine in the course of travel of the valve in its closing direction. The stopper member 4 is usually constructed as an adjusting screw as illustrated, and it cooperates with a surface 6 of a receiving portion of an arm-shaped receiving member 5 extending from the throttle valve 2. The adjusting screw constituting the stopper member 4 is threaded in a supporting bracket 4*a* and is urged rearwards by a spring 4*b*.

The above construction is not particularly different from the conventional construction.

According to this invention, either the stopper member 4 or the receiving member 5 or both is provided with a portion 7 which can be easily deformed or worn, and thus in the initial stage after the beginning of use of the engine, the portion 7 is gradually deformed or worn, and thereby the idling position is gradually shifted in the closing direction of the throttle valve 2 to compensate for loosening of parts during engine break-in which would ordinarily result in an increased idle speed for the engine.

To explain this in greater detail, in an embodying example shown in FIG. 1, the front end portion of the adjusting screw constituting the stopper member 4 is formed as a pointed tapered portion so that the front end portion serves as the deformable or worn portion 7. Namely, in this example, the tapered portion 7 becomes gradually deformed or worn, resulting in a decreased length in the course of repeated operations thereof, so that the idling position of the throttle valve 2 can be gradually shifted in the closing direction.

Figure 2:
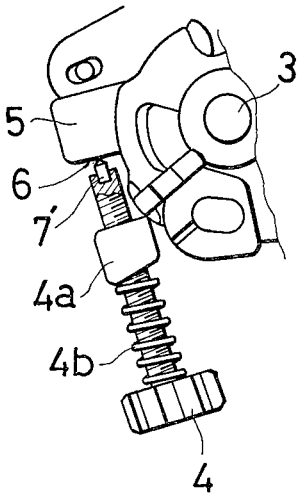
FIGS. 2 and 3 are sectional views, partly in section, of modifications thereof.

In the embodying example shown in FIG. 2, the portion 7' is constituted as an insert of material that can be easily deformed or worn, for instance, synthetic resin. The adjusting screw constituting the stopper member 4 is made of a wear-resisting material, as a whole, such as steel or the like, but only the front end portion thereof is made of the easily worn material to form the portion 7'.

Figure 3:
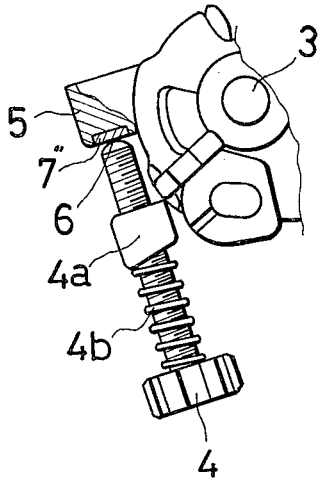

In the embodying example shown in FIG. 3, a portion 7'' is provided in the receiving member 5. Namely, the surface 6 of the receiving member which is contacted by the stopper member 4 is made of a different material, such as synthetic resin, or the like which can be easily deformed or worn.

Thus, if the wearable portion 7'' is provided on the throttle valve 2 side as in the embodying example in FIG. 3, the deformed or worn amount is memorized on the throttle valve 2 side, resulting in the advantage that there occurs no trouble even when the adjusting screw constituting the stopper member 4 has been replaced in the course of use. Additionally, in this case, the formation of the portion 7'' may be simply effected by forming portion 7'' as a plate member and press-fitting the plate member in a recess in receiving member 5 or adhesively joining the plate member in the recess, or securing the plate member in the recess in any other suitable manner. This results in easy manufacture.

The operation of the apparatus is as follows.

Before use, the wearable portion 7 or 7' or 7'' undergoes neither deformation nor wear, so that the throttle valve 2 is stopped at its idling position corresponding to the position of the stopper surface. At the initial stage of use of the engine after assembly thereof, however, the idling speed of the engine gradually increases due to the initial breaking-in of the engine as previously mentioned, and during this period the portion 7 or 7' or 7'' is gradually deformed or worn by repeated contact thereof, and thereby the idling position of the throttle valve 2 is gradually shifted in the direction of closing in accordance with the worn or deformed amount of portion 7, 7' or 7''.

In summary, the engine has the tendency to gradually increase its idling speed and the construction of the stopper assembly of the throttle valve is such as to automatically compensate this tendency by gradually shifting its idling position in the direction of closing of the throttle valve. Consequently, the engine can be automatically kept at a substantially constant idling speed.

Thus, according to this invention, the increase in idling speed in the initial stage after commencement of use of an engine is automatically compensated, and thus the operation thereof can become simple and easy.

In the embodiment of FIG. 1, the front end portion 7 of the stopper member 4 has a cone angle of about 25 to 30 degrees, and the same is made of steel. In the embodiment of FIG. 2, the portion 7' is formed of Teflon such as polyfluorotetraethylene or the like and the same is about 2 mm in diameter and projects a distance above the surface of the stopper member 4 by an amount of about 0.35 mm. In the embodiment shown in FIG. 3, the portion 7'' is made of Teflon such as polyfluorotetraethylene or the like and has a thickness of about 0.35 mm.

What is claimed is:

1. In throttle valve apparatus in an internal combustion engine in which a throttle valve is stopped, in the course of its travel in a closing direction, in an idling position by a stopper member which contacts a receiving member fixed to the throttle valve, the improvement wherein at least one of the stopper member or the receiving member on the throttle valve is provided with a portion which can be easily deformed or worn, so that in an initial stage after the commencement of use of the engine, said portion is gradually deformed or worn whereby the idling position of the throttle valve is gradually shifted in the direction of closing of the throttle valve.

2. A throttle valve apparatus as claimed in claim 1, wherein the stopper member includes a tapered front end portion which constitutes said easily deformed or worn position so that said stopper member can be easily deformed or worn at the front end portion.

3. A throttle valve apparatus as claimed in claim 1, wherein the stopper member has a front end portion which constitutes said gradually deformed or worn portion and comprises synthetic resin.

4. A throttle valve apparatus as claimed in claim 3, wherein said front end portion is a separate inset part in said stopper member.

5. A throttle valve apparatus as claimed in claim 1, wherein the receiving member is provided with a receiving surface portion facing the stopper member constituted at least in part by said easily deformed or worn portion.

6. A throttle valve apparatus as claimed in claim 5, wherein said easily deformed or worn portion is a synthetic resin.

7. A method of compensating for increased engine idle speed upon breaking-in of an engine, said method comprising halting a throttle valve controlling admission of air-fuel mixture to the engine in an idling position of the engine, and gradually and automatically shifting the halted idling position of the throttle valve in its closing direction to diminish the flow of air-fuel mixture to the engine to compensate for increased engine idle speed upon breaking-in of the engine.

8. A method as claimed in claim 7 wherein the gradual and automatic shifting of the idling position of the throttle valve is obtained by constructing two contacting parts which define the idling position of the throttle valve such that the parts gradually approach one another after repeated contact with one another.

9. A method as claimed in claim 8 wherein one of said parts is formed with a relatively easily worn or deformable portion at the region where said parts come into contact so that said portion undergoes gradual wear or deformation.

* * * * *